US006201768B1

(12) United States Patent
de Meyer et al.

(10) Patent No.: US 6,201,768 B1
(45) Date of Patent: Mar. 13, 2001

(54) TIME APPARATUS FOR ALERTING AT TIMES FOR TAKING MEDICINES

(75) Inventors: Pieter H. de Meyer, Raamsdonkveer; Rob Erik Alphons Froeling, Oosterhout; Paul J. Seegers, Dongen; Hendrik-Jan Vertegaal, Leiden, all of (NL)

(73) Assignee: Innocreate N.V., Curaco (AN)

( * ) Notice: Subject to any disclaimer, the term of this patent is extended or adjusted under 35 U.S.C. 154(b) by 0 days.

(21) Appl. No.: 09/405,204

(22) Filed: Sep. 24, 1999

Related U.S. Application Data

(63) Continuation of application No. PCT/NL97/00155, filed on Mar. 26, 1997.

(51) Int. Cl.[7] ..... G04B 47/00
(52) U.S. Cl. ..... 368/10; 368/107
(58) Field of Search ..... 368/10, 107–113

(56) References Cited

U.S. PATENT DOCUMENTS

| | | |
|---|---|---|
| 4,526,474 | 7/1985 | Simon . |
| 4,588,303 | 5/1986 | Wirtschafter et al. . |
| 4,660,991 | 4/1987 | Simon . |
| 4,858,207 | 8/1989 | Buchner . |
| 5,246,136 | 9/1993 | Loidl . |

FOREIGN PATENT DOCUMENTS

| | | |
|---|---|---|
| 2131983 | 6/1984 | (DE) . |
| 0159306 | 10/1985 | (EP) . |
| 0289678 | 11/1988 | (EP) . |
| 0301672 | 2/1989 | (EP) . |
| 0407178 | 1/1991 | (EP) . |
| 0496790 | 8/1992 | (EP) . |
| 2703906 | 10/1994 | (FR) . |
| WO 80/00755 | 4/1980 | (WO) . |

*Primary Examiner*—Bernard Roskoski
(74) *Attorney, Agent, or Firm*—Hoffman & Baron, LLP

(57) ABSTRACT

Timer apparatus (10), comprising a timer (11) and command means (12, 14, 15, 19) and alerting means (13) connected to the timer, in which at a starting time (tr) the timer (11) determines a first nominal alert interval (Tn) which begins at the starting time (tr) and ends at a nominal alert time (tn), on the occurrence of the nominal alert time (tn) the timer (11) controls the alerting means (13) so that they deliver an alert signal, and on receipt of a starting signal from a starting command element (12) of the command means the timer (11) restarts with the current time (t) as the starting time (tr). On receipt of the starting signal the timer (11) determines a time window (Tw) which contains the nominal alert time (tn). The timer (11) controls the alerting means (13) so that they deliver the alert signal during the window (Tw).

12 Claims, 4 Drawing Sheets

TIME APPARATUS FOR ALERTING AT TIMES FOR TAKING MEDICINES

This application is a continuation of PCT/NL97/00155 filed Mar. 26, 1997.

The invention relates to a timer apparatus according to the preamble of claim 1.

A timer apparatus of this type is disclosed by G.B.-A-2131983. The prior art apparatus is designed as a contraceptive warning device. The timer of the apparatus is based on a normal clock with a 12 or 24 hour cycle. In use a woman programs the timer with the day she is starting her course of contraceptive pills, the starting time she prefers to take the pill and the current time of day. At a fixed time, e.g. 1 hour before the preferred time programmed by her to take a pill, a "clear" indicator will be replaced by a "warning" indicator. If the woman takes the pill she presses a manual reset button to therewith change the indicator to "clear". If the timer has not been set to "clear" before a second fixed time, e.g. 11 hours after said preferred time to take a pill, then an audible warning will sound at intervals during a further 1 hour. If the indicator has not been reset (the pill presumably not having been taken) by those 12 hours after the preferred time to take a pill, the indicator will remain in the "warning" state then and will show that the pill may be ineffective for the remainder of the course. The "warning" indicator can only be changed now by resetting the timer, otherwise it will continue to indicate the "warning" until the 22nd day of the course. On the 22nd day, whether the "warning" state exists or not, the timer will indicate "clear" until the 28th day during which time the pill is not taken and menstruation normally takes place.

According to the above a warning enable window with a fixed duration, e.g. 13 hours, will occur with fixed intervals of 24 hours between preferred times inside the windows to take respective pills.

With the prior art apparatus a woman using the timer must program it at the start of her course with several data about when she prefers to take contraceptive pills for each day of a course. This requires to provide the apparatus with several appropriate command keys for entering these data. This makes the apparatus complex and expensive. Besides, it makes the timer apparatus difficult to operate, and mistakes can easily be made, for example when the user wishes to change said data, whether or not during a course for taking pills. The prior art device will therefore not be suitable for some people, for example for people with an irregular waking/sleeping pattern, or for example for people who travel or work shifts.

The object of the invention is to eliminate the above-mentioned disadvantages and to provide a timer apparatus which is integral with or separate from a medicine dispensing device, and by means of which the earliest time at which a medicine may be taken can be brought forward or delayed with the minimum of actions.

This object is achieved by means of the timer apparatus according to claim 1.

The timer apparatus requires only a single command element. Said command element serves to stop the delivery of an alert signal and at the same time to restart the timer. The very first starting time is in particular the time at which the apparatus is first used. The device for setting the first starting time therefore does not require an additional command element. This means that the timer apparatus can be of a very simple design, and the apparatus is very simple to use, while mistakes when alert times are being changed are avoided.

Nevertheless, the timer apparatus according to the invention can still be designed with additional command elements, for example a numeric keyboard, for entering an hours/minutes combination as the first starting time. The timer can then also be designed with an ordinary clock function, in which a new nominal alert time is calculated by adding the alert interval to the current time of day.

Other features and advantages of the invention will emerge from the explanation which follows of preferred embodiments of the timer apparatus according to the invention in conjunction with the appended drawings, in which.

Figure 1:
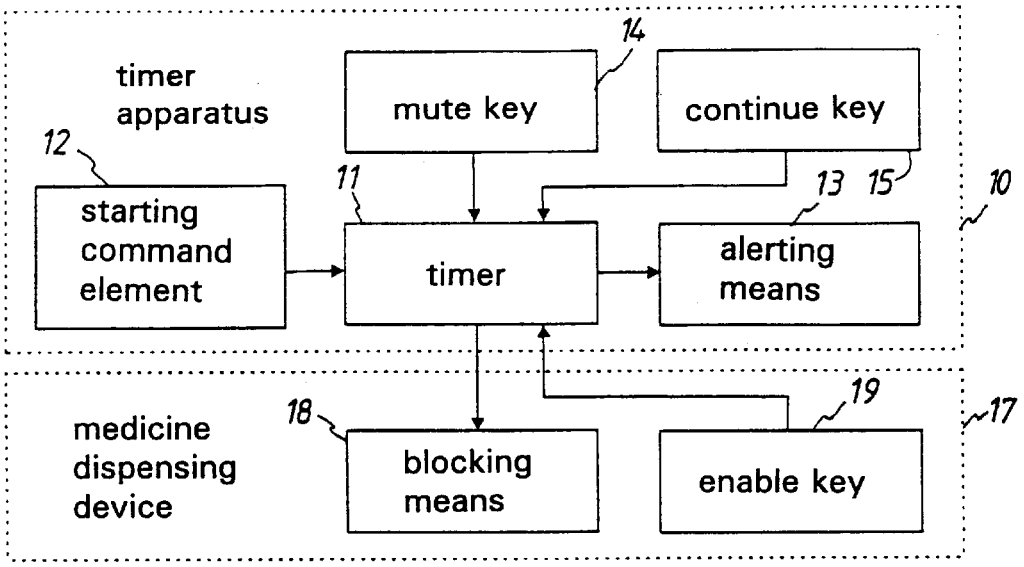
FIG. 1 shows diagrammatically a timer apparatus according to the invention in combination with a medicine dispensing device.

As shown in FIG. 1, a timer apparatus 10 according to the invention comprises a timer 11 to which a starting command element 12, alerting means 13, a mute key 14 and a continue key 15 are connected.

The timer apparatus 10 can be integral with a medicine dispensing device 17 which comprises blocking means 18 and an enable key 19.

The medicine dispensing device 17 is designed, for example, as described in another international patent application filed today by applicants.

If the timer apparatus 10 is being used independently, the starting command element 12 can be a starting key. If the timer apparatus 10 and the medicine dispensing device 17 are integral, the starting command element 12 can be a switch which is actuated when a medicine is being removed from the medicine dispensing device 17.

Figure 8:
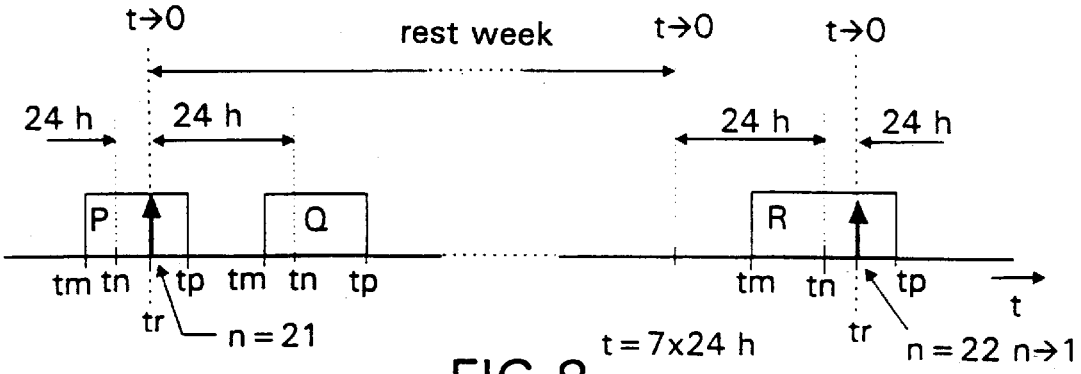
FIG. 8 shows a time chart for explanation of the mode of operation according to FIG. 7.
Figure 3:
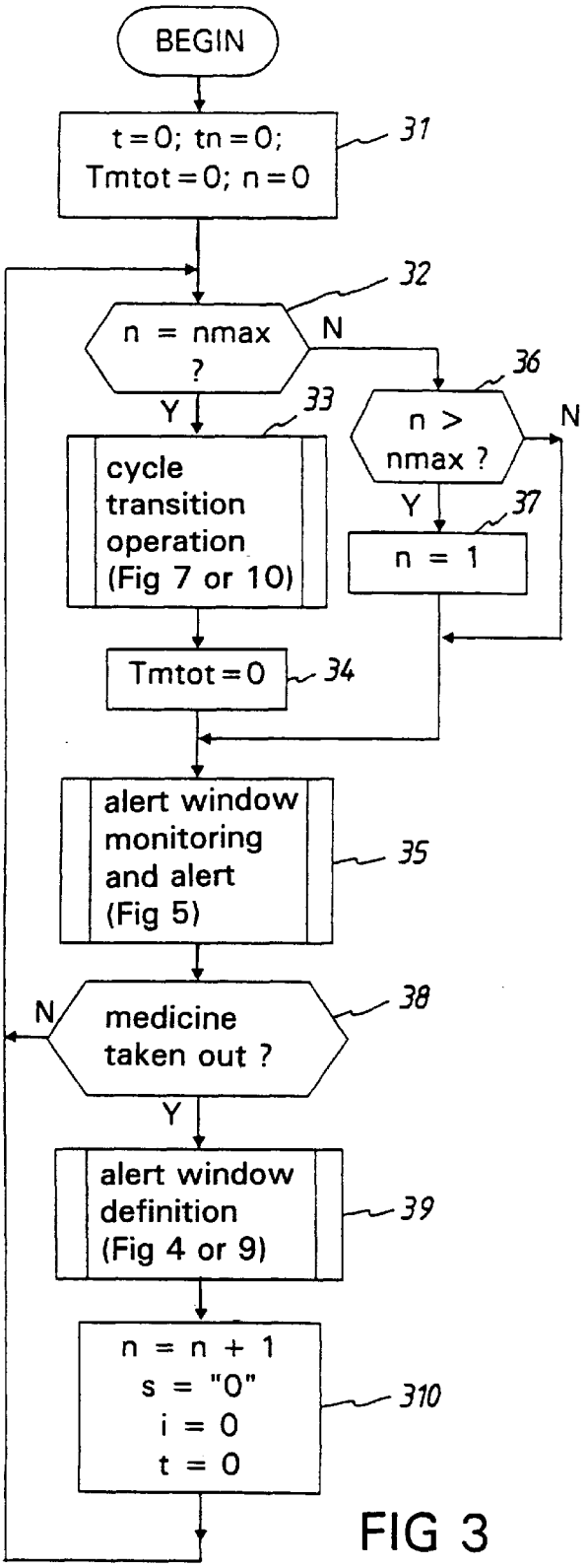
FIG. 3 shows a flow chart of a mode of operation of an embodiment of the timer apparatus of FIG. 1.

The mode of operation of the timer apparatus 10 will be explained below with reference to the time charts of FIGS. 2 and 8 and the flow charts of FIGS. 3 to 7 and FIG. 10.

The letters of variables have the following meaning below and in the figures:

| | |
|---|---|
| c | continue |
| i | increment (i, Ti) |
| n | number of medicines removed |
| nmax | a maximum number of medicines to be removed |
| s | mute |
| t | time elapsed since tr |
| Ti | increment interval |
| tm | starting time of alert window |
| Tm | window part prior to (minus) tn |
| Tmf | fixed value for Tm |
| Tmtot | a total brought-forward time which has occurred |
| tn | nominal alert time at the end of Tn |

-continued

| | |
|---|---|
| Tn | nominal alert interval (from tr to new tn) |
| Tnmax | a maximum permitted brought-forward time |
| tp | finishing time of alert window |
| Tp | window part following (plus) tn |
| Tpf | fixed value for Tp |
| Tpmax | a maximum permitted delay time |
| Tptot | a total delay time which has occurred |
| tr | starting or resetting time |
| ts | starting time of alert mute |
| Ts | an alert mute interval |
| TW | the duration of an alert window |

When the timer apparatus 10 is used for the first time, it is preferable according to the invention that no time and/or time interval should have to be set. Instead of that, the timer 11 is started the first time and every time thereafter at a time tr which is determined by a starting signal delivered by the starting command element 12, in such a way that at the starting time tr the time to be measured or to be counted becomes t=0, which is indicated by t→0 in FIGS. 2 and 8. However, in this connection it is pointed out that in the flow charts an assignment of a value to a variable is indicated by an equal sign (=).

At each starting time tr the timer 11 initializes a time interval Tn of a fixed duration. If the medicines are contraceptive pills, Tn=24 hours. The time interval Tn thereafter is called normal or nominal time interval (with normal or nominal duration). Unless the timer 11 receives a resetting signal at an earlier time, each nominal interval Tn ends at a time tn.

An important feature of the invention is that at each starting time tr on either side of the time tn of the restarted nominal interval Tn the timer 11 defines a time window Tw consisting of a part Tm and a part Tp prior to and following the finishing time tn of the nominal interval Tn respectively. The window Tw begins at a time tm and ends at a time tp. From the starting time tm of each window Tw the timer 11 controls the alerting means 13 so that they deliver an alert signal, which can be, for example, audible and/or optical. This ensures that the timer apparatus 10 reminds already before the occurrence of the normal alert time tn that a medicine has to be taken. It is then possible to opt for the removal of a medicine and the restarting of the timer 11, or to wait to remove a medicine, for example until the normal removal time tn. In the latter instance an audible alert signal can be suppressed by pressing a mute key 14. The suppression of an audible alert signal for, for example, one hour is also useful if the timer apparatus 10 is being carried by the user, and the latter is in an environment in which the audible alert signal is experienced as a disturbance.

If a user takes a medicine during the window part Tm and takes a medicine before the nominal alert interval Tn has elapsed, the finishing time tn of the next nominal interval Tn is brought forward by the same amount. This can be useful for people who, for example, travel or work shifts. It is possible in this case to bring forward the time in such a way that a point at which a medicine has to be taken travels or shifts along with the time. The invention thus provides the possibility of a shifting alert interval. If the medicines are contraceptive pills, the first window part Tm has a duration of, for example, 5 hours.

The second window part Tp of each window Tw ensures that the time tm at which an alert signal begins can occur later than the last nominal time tn plus the duration of the normal interval Tn. This aspect is known per se for an indefinite (infinite) duration of the window part Tp, for example from EP-A-496790 and U.S. Pat. No. 4,858,207. However, since the window part Tp according to the invention has a limited duration, it is now possible to define that the removal of a medicine inside the window Tw is safe, and outside said window Tw is unsafe. According to the invention, the timer 11 monitors this phenomenon and, if a medicine is removed outside the window Tw, the timer 11 controls the alerting means 13 so that they deliver an appropriate alert signal. If the medicines are contraceptive pills, the second window part Tp has a duration of, for example, 6 hours.

Within the scope of the invention, the window parts Tm and Tp can have any suitable duration, depending on the type of medicines and the instructions for taking. This can be taken into account in the design of the apparatus 10.

The timer apparatus 10 can be designed in such a way that if the timer 11 is not restarted within a time window Tw, an audible alert signal continues to sound (but not if a waiting period is fixed (73, 105)). However, this can wrongly suggest to a user that it is safe to take a medicine. In the case of some medicines this can have serious repercussions for the health of the user. For that reason, an audible alert signal is preferably delivered only during an alert window Tw.

Figure 2:
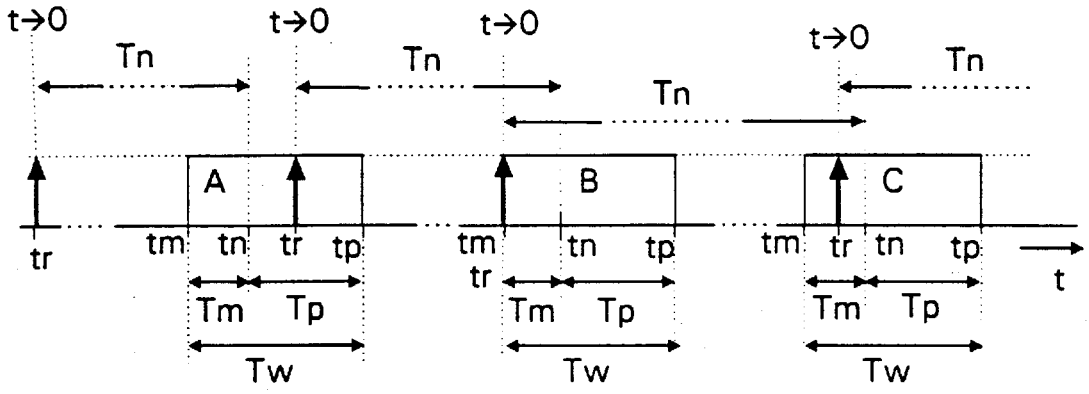
FIG. 2 shows a time chart of a mode of operation of the timer apparatus of FIG. 1.

FIG. 2 shows on the far left a starting time tr for the removal of a first medicine when using the timer apparatus 10 for the first time, followed by three windows A, B, C, in which the restarting time tr is delayed, brought forward and brought forward respectively relative to the nominal alert time tn.

In the flow charts explained below and shown in the figures a letter "N" at an output of a decision box represents an answer "NO" to a condition tested in the box, and a letter "Y" at another output of the decision box represents an answer "YES" to the tested condition.

The boxes of the flow charts following a "START" box and ending at a "FINISH" box are indicated by numbers which are placed between parentheses below. The first digit (for FIG. 10 two digits) of these numbers indicates the number of the figure in which the boxes are shown.

The timer apparatus 10 is initialized once (31). Tmtot represents the total brought-forward time which has occurred over a predetermined period, and n represents the number of medicines removed or the number of times the starting signal has occurred.

If the number n of medicines removed is nmax (32), the next step is a cycle transition processing (33) (FIG. 7 or 10), which relates to a waiting time which may have to be entered, in particular when refilling the medicine dispensing device 17. After the cycle transition processing (33), Tmtot is reset to zero (34), and a routine (35) for monitoring the occurrence of the time window Tw (53), (54) (FIG. 5) and for delivering an alert signal (55) during the window Tw follows. The routine for the alert window monitoring and alert (35) is executed (32), (36), (37) for each number n of medicines removed. Since at initialization the window Tw is undefined (or can be undefined), in this instance, in which the number n of medicines removed is zero (52), the remainder of the last-mentioned routine (35) is skipped.

So long as no medicine is removed, at least so long as the starting command element 12 does not deliver (38) a starting signal, the system returns to the test of the number n of medicines removed (32), (36), (37).

Figure 4:
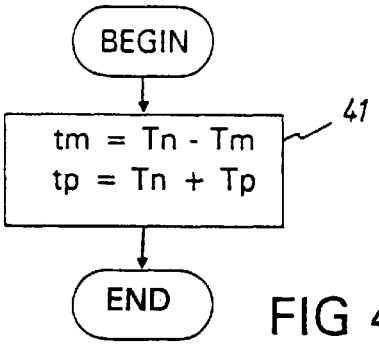
FIG. 4 shows a flow chart of an embodiment of the alert window definition of FIG. 1.
Figure 5:
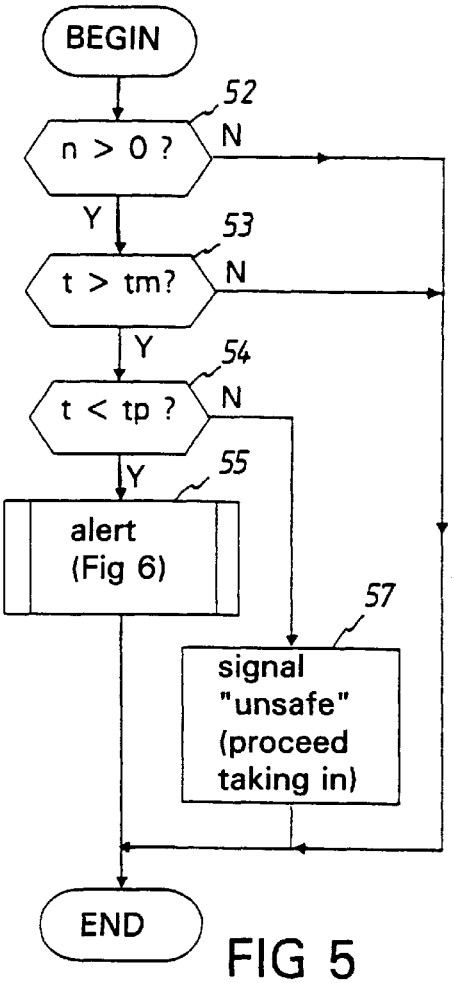
FIG. 5 shows a flow chart of a mode of operation of the alert window monitoring of FIG. 1.
Figure 6:
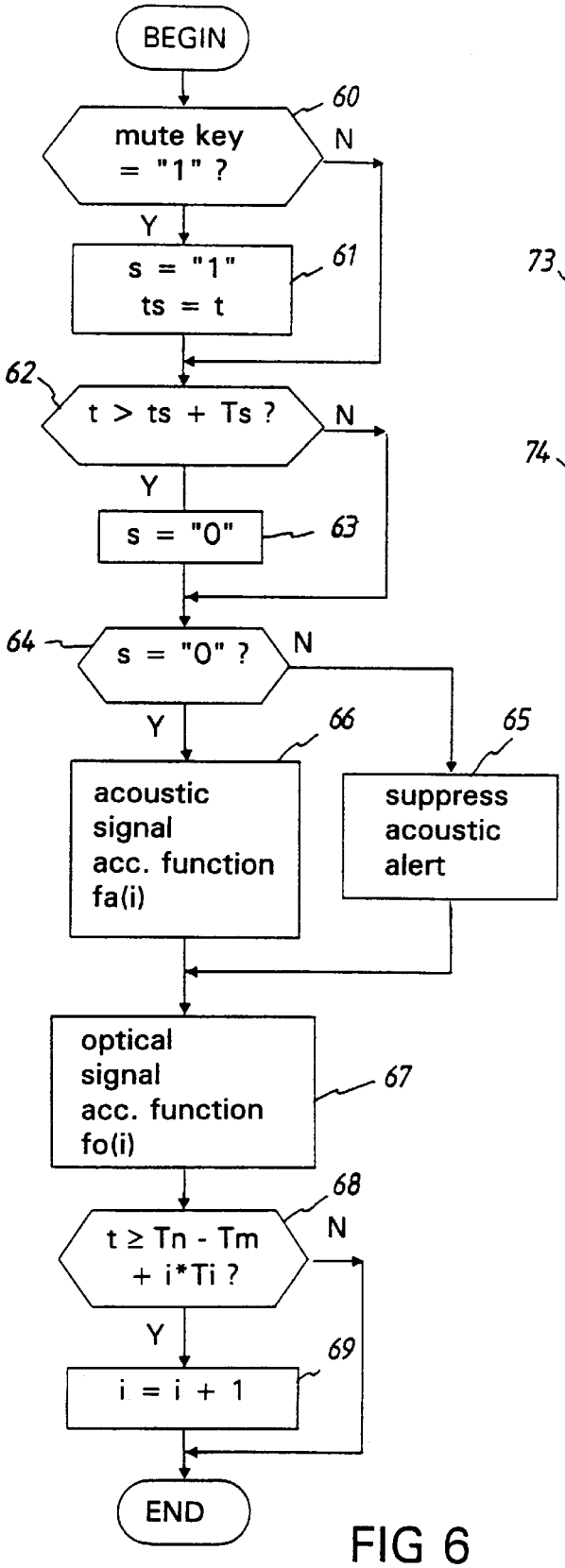
FIG. 6 shows a flow chart of an embodiment of an alert mode of operation of FIG. 5.
Figure 9:
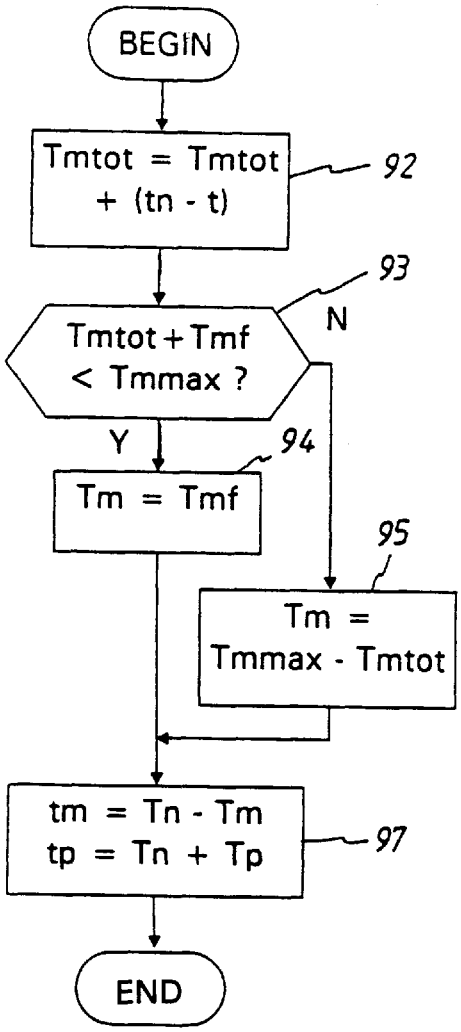
FIG. 9 shows a flow chart of another embodiment of the alert definition of FIG. 1.
Figure 10:
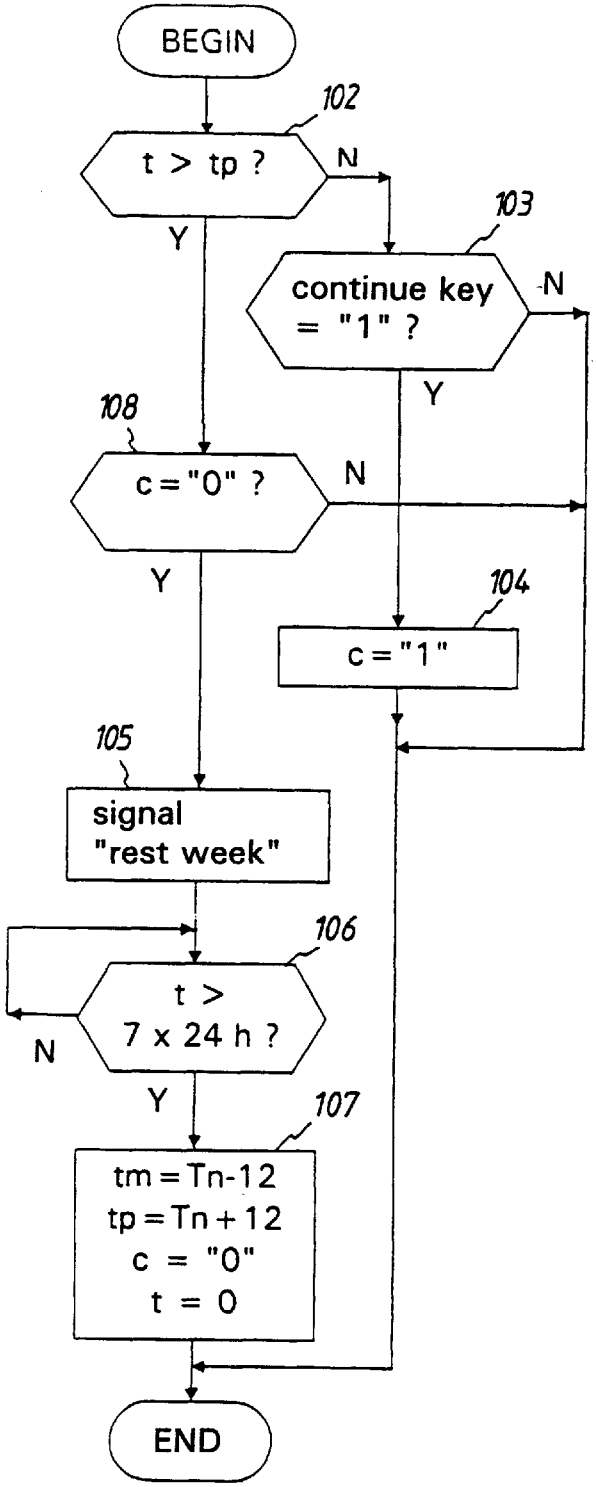
FIG. 10 shows a flow chart of another embodiment of the cycle transition processing of FIG. 1.

When a medicine is removed, at least when the starting command element 12 delivers (38) a starting signal, the alert window is again defined (39) (FIG. 4 or 9). If the parts Tm and Tp of the window Tw do not change, the alert window definition (39) can be replaced by assigning fixed values to the starting time tm and the finishing time tp of the window Tw during the initialization (31). In other cases these times tm, tp must be calculated (41), (75), (94), (95), (97), (107).

A variable t, which can simply represent the elapsed time, is subsequently reset to zero, and the number n of medicines removed is increased by one (310).

Prior to each subsequent removal of a medicine, the operation explained above is repeated from the test on the number n of medicines removed (32), (36), (37) onwards.

If the starting command element 12 delivers a starting signal after the occurrence of a last-defined window Tw (54), the timer 11 controls the alerting means 13 so that they deliver a suitable signal, for example "unsafe" (57). Nevertheless, it is possible to proceed to remove medicines, in which case the starting command element 12 continues to deliver a starting signal for each medicine removal. This possibility is important, for example, if the medicines are contraceptive pills.

As stated above, an audible alert signal can be delivered by the alerting means 13 from the beginning tm of the occurrence of the alert window Tw, but this signal can be suppressed by means of the mute key 14. According to FIG. 6, the time the sound suppression lasts can be limited to Ts. For this purpose, when the mute key is pressed (60), a logical variable s is made "1", and a time variable ts is made t (61). If the elapsed time t has increased by the maximum sound suppression time Ts (62), the logical variable s is made "0" (63). In any case it is tested whether s="0" (64). If s="1", the audible alert is suppressed (65). Otherwise, the audible signal preferably occurs according to a function fa(i) (66). Although not shown in detail, the audible signal according to the function fa(i) preferably consists of increasing the obtrusiveness of an audible signal stepwise (rising periodically). The way in which the obtrusiveness of the sound can be increased can depend on various factors, for example the type of medicines and the environment in which they are being used. The sound signal is, for example, an intermittent sound signal whose strength increases periodically. Various sound frequencies and combinations thereof can also be used. The logical variable s for the suppression of the audible alert and the counting variable i for the audible signal function fa(i) and of an optical signal function fo(i) are set to zero (310) after the removal of a medicine (38).

The alerting means 13 can be suitable for the delivery of various types of alert signals. An audible signal of the type explained above is an example. Another example is an optical signal which depends on the function fo(i) (67). The optical signal can comprise the display on a screen of the number n of medicines removed, whether or not taking the medicine is "safe" (57), a waiting period (73), (105), and the display of a periodic increase in the time t which has elapsed since the beginning of the occurrence of the last-defined window Tw. If the medicines are contraceptive pills, the last-mentioned presentation of the periodically increased time can be indicated by four indicators, of which the second, third and fourth are also activated whenever a period of two hours has elapsed. A counting variable i which is suitable for this can be the same counting variable i as that for the audible signal function fa(i) (66). The counting variable i is used for determining the time which has elapsed since the beginning of the occurrence of the time window Tw (68). Whenever a time duration Ti corresponding to a unit of the counting variable i has elapsed, the counting variable is increased by one (69).

The abovementioned waiting time which occurs after a predetermined number nmax of medicines (32) has been reached occurs also when no medicine has been removed at the time tp (72) before the time window Tn has elapsed, or at least if the starting command element 12 has not delivered a starting signal (38). If both conditions, n=nmax and t>tp, are met, the timer 11 preferably controls the alerting means 13 so that they indicate the prescribed waiting period (73). In the case of contraceptive pills the waiting period is one week, and the signal can consist of displaying the word "rest week" or simply "rest" on a screen. So long as the prescribed waiting period has not elapsed, the timer 11 takes no further action (74). After the waiting period has elapsed, the next window Tw can be defined differently from subsequent windows. In the case of contraceptive pills the time window Tw can be, for example, 12 hours on each side of the next nominal alert time tn (75).

Figure 7:
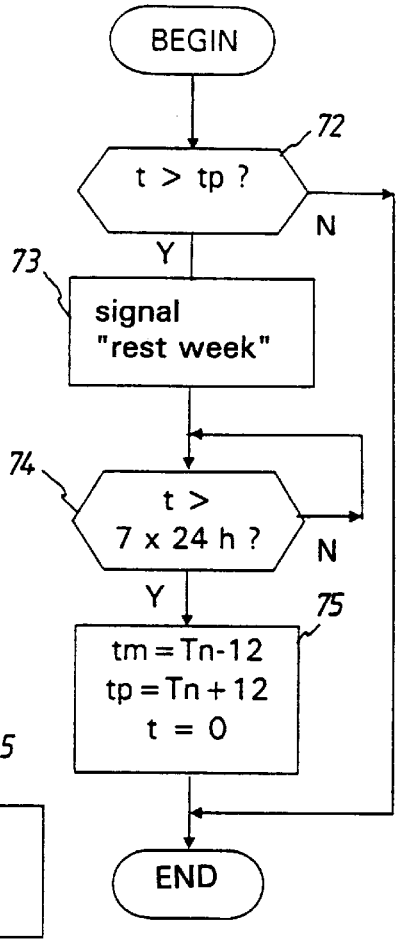
FIG. 7 shows a flow chart of an embodiment of the cycle transition processing.

After a predetermined number nmax of medicines has been removed, the user can deliberately select a waiting period by not removing a medicine during the next window Tw, or the user can skip this waiting period, deliberately or not, by removing a medicine during the next window Tw, as explained with reference to FIG. 7. The mode of operation of the timer apparatus 10 during the occurrence of a waiting period, as explained with reference to FIG. 7, is also shown in the time chart of FIG. 8 for cases where the medicines are contraceptive pills. Of the windows P, Q, R shown, a 21st pill is taken within the window P, with the result that n=21 (37), and during the next window Q no pill is removed, or at least the starting command element 12 does not deliver a starting signal, so that the next window Q is determined at a time which occurs 7×24 hours after the last starting time tr (in the window P). After the removal of the next pill (35), the number of pills removed becomes n=22 (37), but after a suitable test (33) this number n is reduced to n=1. Since unwitting or unintentional skipping of the waiting period is undesirable, the invention provides monitoring thereof. If, according to FIG. 10, after the removal of the predetermined number of medicines nmax, the continue key 15 is pressed (103) prior to reaching the finishing time tp of the next window Tw (102), a logical variable c is made "1" (104). If, after the next window (102) has elapsed, following the removal of the predetermined number nmax of medicines (32), the logical variable is found to be c="0" (108), the waiting period 105, 106, 107 is gone through, and otherwise the waiting period is skipped.

According to FIG. 9, the mode of operation of which replaces the mode of operation according to FIG. 4, after the removal of a medicine (38), a total brought-forward duration Tmtot from the occurrence of the start of the time windows Tw is calculated (92). If the sum of the total brought-forward time Tmtot which has occurred and a normal duration Tmf of the first part of the time window Tw is smaller than a maximum permitted time duration Tmmax (93), the normal time duration Tmf is not assigned (94) to the first window part Tm, but a maximum permitted, remaining brought-forward time Tmmax−Tmtot (95) is assigned to said window part. The duration assigned to the first part Tm of the time window Tw is used in the same way as before for calculating the starting time tm and the finishing time tp of the window Tw (97).

In addition to a limiting of the total brought-forward time within a particular period (32), the total delay time Tptot can be limited to Tpmax in a similar way. Although not shown, a chart similar to that of FIG. 9 can be drawn up for the last-mentioned mode of operation. The difference from FIG. 9 in that case is the replacement of the letter "m" by "p" (also in block 36) and transposing "tn" and "t" in block 92.

As stated, the timer apparatus 10 according to the invention can be used independently, or it can be integral with the medicine dispensing device 17. The blocking means 18 of the medicine dispensing device 17 are means which block the removal of a medicine. The timer 11 is suitable for controlling the blocking means 18 for removal of the blocking during the occurrence of a window Tw.

In order to reduce the energy consumption by the blocking means 18 during the occurrence of a window Tw, the combined device 10, 17 preferably comprises the enable key 19 which the user has to press during the occurrence of the window Tw, in order to remove the blocking by the blocking means 18 by way of the timer 11.

Another alternative (not shown) can be that if a medicine is removed in the interval part Tp which follows a nominal alert time tn, the following nominal time tn is made identical to the earlier nominal time. This function can be activated temporarily by means of a key. This function can be useful if in the example of contraceptive pills a user has had to delay taking the pill for several successive days, but subsequently wants to be able to take a pill again at a normal time.

The invention also covers an embodiment of the timer apparatus in which the first nominal alert interval is not constant, but can have a duration from a series of successive time durations, for example a repeated series of in succession 20, 50, 90 and 20 minutes. This can depend on a concurrence of the more or less simultaneous taking of various medicines.

What is claimed is:

1. Timer apparatus (10) comprising a timer (11) and command means (12, 14, 15, 19) and alerting means (13) connected to the timer, in which at a starting time (tr) the timer (11) determines a first nominal alert interval (Tn) which starts at the starting time (tr) and which ends at a nominal alert time (tn) in a time window ($T_w$), in the time window ($T_w$) the timer (11) controls the alerting means (13) so that they deliver an alert signal until receipt of a reset signal at a reset time, and the command means then starts subsequent nominal alert intervals (Tn) with associated time windows (Tw) at a starting time in a present time window ($T_w$), characterized in that the reset time in a window ($T_w$) is made the starting time (tr) for a subsequent nominal alert interval (Tn), and the duration of a next window is made depended from a time difference between a starting time (tr) in a window and a nominal alert time (tn) of a preceding window.

2. Timer apparatus (10) according to claim 1, characterized in that for each reset time (tr (=t)) the timer (11) determines a difference time (tn−t) of the nominal alert time (tn) minus the reset time (tr), the timer determines the sum (Tmtot) of the difference times of a number of successive windows (Tw) and, if the sum exceeds a predetermined threshold value (Tmmax), the timer (11) shortens a window part (Tm) preceding the nominal alert time (tn) of a subsequent window (Tw) by the time by which the threshold value has been exceeded (Tmmax−(Tmtot+Tmf)).

3. Timer apparatus (10) according to claim 1, characterized in that for each reset time (tr (=t)) the timer (11) determines a difference time (t−tn) of the reset time (tr) minus the nominal alert time (tn), the timer determines the sum (Tptot) of the difference times of a number of successive windows (Tw) and, if the sum exceeds a predetermined threshold value (Tpmax), the timer (11) shortens the window part (Tp) succeeding the nominal alert time (tn) of a subsequent window (Tw) by the time by which the threshold value has been exceeded (Tpmax−(Tptot+Tpf)).

4. Timer apparatus (10) according to claim 2, characterized in that the threshold value (Tmmax; Tpmax) is twelve hours.

5. Timer apparatus (10) according to claim 1, characterized in that if a last-determined window (Q) follows a predetermined number (nmax) of windows (Tw), and provided that the timer (11) receives a continuation signal from the command means (15), the timer (11) determines (75, 107) a subsequent window (R) at the end of a second nominal alert interval (74, 75; 106, 107).

6. Timer apparatus (10) according to claim 5, characterized in that the timer (11) makes the time window (R) at the end of the second nominal alert time interval twelve hours on each side of the nominal alert time (tn) of the window (R).

7. Timer apparatus (10) according to claim 1, characterized in that the form of the alert signal depends on the occurrence or absence of the starting time (tr) relative to one or more earlier determined windows (Tw).

8. Timer apparatus (10) according to claim 1, characterized in that during a window (Tw) the alert signal comprises an audible signal, the obtrusiveness of which increases with time (t).

9. Timer apparatus (10) according to claim 1, characterized in that during a window (Tw) the alert signal comprises an audible signal, and following receipt of a mute signal from a mute command element (14) of the command means the timer (11) suppresses the audible signal for a predetermined third interval (Ts).

10. Timer apparatus according to claim 1, characterized in that the command means have a command element in order to ensure that a subsequent nominal alert time (tn) is not made later than 24 hours from the last nominal alert time (tn).

11. Timer apparatus (10, 17) according to claim 1 characterized in that the timer apparatus (10) is integral with a medicine dispensing device (17) which comprises blocking means (18), in which after the starting time (tm) of a window (Tw) the timer (11) delivers a blocking removal signal to the blocking means (18), in order to remove a block on the dispensing of a medicine, and the medicine dispensing device (17) comprises a command element (12) which is connected to the timer (11), and which delivers the reset signal (tr) after a medicine has been dispensed.

12. Timer apparatus (10) according to claim 11, characterized in that the medicine dispensing device (17) comprises an enable command element (19) of the command means which is connected to the timer (11), and the timer (11) delivers the blocking removal signal only on receipt of an enabling signal from the enable command element (19).

* * * * *